US005579646A

United States Patent [19]

Lee

[11] Patent Number: 5,579,646

[45] Date of Patent: Dec. 3, 1996

[54] CRYOGEN DELIVERY APPARATUS

[75] Inventor: Ron C. Lee, Bloomsbury, N.J.

[73] Assignee: The BOC Group, Inc., New Providence, N.J.

[21] Appl. No.: 449,454

[22] Filed: May 24, 1995

[51] Int. Cl.[6] ..... F17C 7/02; F17C 9/02

[52] U.S. Cl. ..... 62/50.2; 62/50.1; 62/47.1; 62/48.1; 62/49.2; 62/50.5

[58] Field of Search ..... 62/47.1, 48.1, 62/49.2, 50.1, 50.2, 50.5

[56] References Cited

U.S. PATENT DOCUMENTS

| | | | |
|---|---|---|---|
| 2,344,765 | 3/1944 | Dana et al. | 62/48.1 |
| 2,938,576 | 5/1960 | Cox et al. | 62/50.5 X |
| 2,943,454 | 7/1960 | Lewis | 62/50.5 |
| 3,097,497 | 7/1963 | Fitt | 62/50.4 |
| 3,260,060 | 7/1966 | Pauliukonis et al. | 62/47.1 |
| 3,263,433 | 8/1966 | Fitt | 62/50.2 |
| 3,304,739 | 2/1967 | Erath | 62/50.4 X |
| 3,318,307 | 5/1967 | Nicastro | 62/50.2 X |
| 3,371,497 | 3/1968 | Singleton | 62/47.1 X |
| 3,827,246 | 8/1974 | Moen et al. | 62/47.1 |
| 3,858,404 | 1/1975 | Davis | 62/50.5 X |

FOREIGN PATENT DOCUMENTS

| | | | |
|---|---|---|---|
| 1581958 | 7/1990 | U.S.S.R. | 62/50.5 |
| 1719822 | 3/1992 | U.S.S.R. | 62/50.5 |

*Primary Examiner*—Christopher Kilner
*Attorney, Agent, or Firm*—David M. Rosenblum; Larry R. Cassett

[57] ABSTRACT

A cryogen delivery apparatus for delivering cryogen in a saturated state includes a vessel to contain the cryogen in liquid and vapor phases. The vessel has a headspace region and a heat exchanger located within the headspace region for indirectly exchanging heat between the vapor located within the headspace region and a liquid stream composed of the liquid phase of the cryogen. In case the cryogen is introduced into the vessel as a subcooled liquid, the vapor will condense into the liquid phase and the subcooled liquid will be converted into a saturated liquid. The saturated liquid will then be discharged from a liquid outlet connected to the heat exchanger. In the event the liquid enters the vessel as two-phase flow, the vessel will act as a phase separator. A branched supply line is provided having a liquid inlet branch connected to a bottom liquid inlet of the vessel so that a supply stream composed of the cryogen flows into the vessel. A vapor inlet branch of the branched supply line is connected to an inlet to the headspace. A heating element is provided to heat the vapor inlet branch so that liquid cryogen is vaporized to replenish vapor within the headspace that is depleted through condensation or discharge from a vapor discharge outlet of the vessel.

11 Claims, 1 Drawing Sheet

FIG.
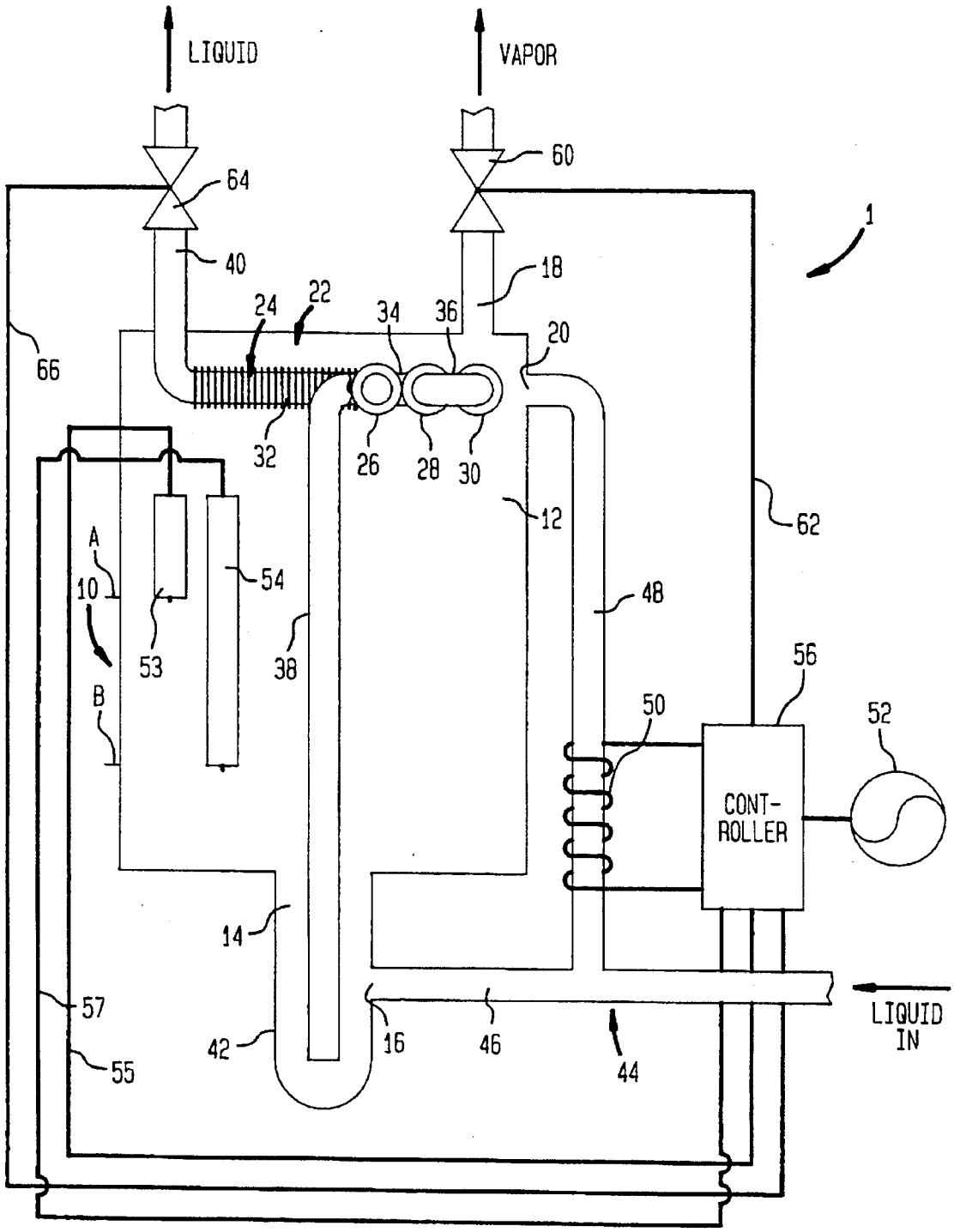

CRYOGEN DELIVERY APPARATUS

BACKGROUND OF THE INVENTION

The present invention relates to a cryogen delivery apparatus for delivering a cryogen in a saturated state. More particularly, the present invention relates to such an apparatus in which a vessel serves as a phase separator in case the cryogen to be delivered is supplied as a two phase flow. The vessel contains a heat exchanger to convert subcooled liquid into a saturated liquid in case the cryogen is supplied as a subcooled liquid.

Cryogenic fluids such as liquid air or liquefied components of air are utilized in many cryogenic cooling and refrigeration applications. A common problem with supplying a cryogenic fluid is that the degree of cooling potential of the cryogenic fluid can vary with the condition of the fluid being supplied. For instance, subcooled liquid nitrogen has a different cooling potential than nitrogen supplied as a two phase flow. This problem is exacerbated in cooling applications that do not employ a feedback control system, but rather, rely on timers and the like to open and close cryogenic supply valves. An example of such a problematic application is where a cryogen is used in cooling blow molded plastic articles after having been formed. In many systems designed for such an application, the flow of the cryogen for each cooling cycle is controlled by a control valve which is opened for a pre-determined time period. The two phase flow form of the cryogen will have less cooling potential than the cryogen as a subcooled liquid. Moreover, the amount of subcooled liquid .that is supplied for a given valve opening will be greater than that of the cryogen supplied as a two phase flow due to the increased density of the subcooled liquid. Since the cooling potential of the cryogen will vary with its physical state, either plastic parts will not be cooled sufficiently or the cryogen will be wasted.

As will be discussed the present invention provides a practical solution to alleviate the problem set forth above by providing a cryogen delivery apparatus that serves as an interface between the liquid cryogen being supplied and the particular application for which the cryogen is being used. The interface provided by the present invention is one that insures that the cryogen will be consistently utilized in a saturated state.

SUMMARY OF THE INVENTION

The present invention provides a cryogen delivery apparatus for delivering a cryogen in a saturated state. The cryogen delivery apparatus comprises a vessel to contain the cryogen in liquid and vapor phases and to phase separate the cryogen into the liquid and vapor phases in case the cryogen is introduced into the vessel as a two phase flow. The vessel has a head space region, a bottom inlet for introducing the cryogen into the vessel, a vapor outlet for discharging the vapor from the head space region, and a head space inlet for introducing vapor into the head space region. A heat exchange means is provided for indirectly exchanging heat between the vapor located within the head space and a liquid stream composed of the liquid phase of the cryogen so that in case the cryogen is introduced into the vessel as a subcooled liquid, the vapor will condense into the liquid phase and the subcooled liquid will be converted into a saturated liquid. A liquid outlet is connected to the heat exchanger for discharging the liquid stream from the vessel. A branched supply line is provided having a liquid inlet branch connected to the bottom liquid inlet so that a supply stream composed of the cryogen flows into the vessel and a vapor inlet branch connected to the head space inlet. A heater means is provided for heating the vapor inlet branch of the branch supply line so that the liquid cryogen is vaporized within the vapor inlet branch to produce the vapor in case the vapor within the head space is depleted through condensation or through discharge through the vapor outlet.

In practice, the cryogen delivery apparatus in accordance with the present invention can have its branched supply line connected to a source of liquid nitrogen. In case such liquid nitrogen is in a two phase state, then, the cryogen delivery apparatus would serve simply to separate the phases into liquid and vapor phases, with the excess vapor being vented from the vessel. If however, the nitrogen storage tank were filled and the subcooling within the tank dramatically increased, then the heat exchange means would serve to exchange heat between the headspace vapor and the subcooled liquid being withdrawn to convert the subcooled liquid into saturated liquid upon its discharge from the vessel.

In the event that subcooled liquid is being supplied and/or vapor is being utilized, the liquid level within the vessel will tend to rise. In order to replace the vapor that has been depleted, vapor is supplied to the headspace region of the vessel through the heated vapor inlet branch of the supply line. It is to be noted that by simply heating only a stream of the liquid (as opposed to all of the liquid contained within the vessel), power requirements of a heater for such purpose can be minimized. The heating can be at a constant level, where requirements do not vary, or can be proportional to the use of liquid. The heater can be used at the conclusion of a batch process and in such case, evolved vapor will cause liquid to back-flow through the branched supply line.

It is to be noted that the term "cryogen" as used herein and in the claims means a liquified atmospheric gas such as nitrogen, liquid air, other cold liquid substance which under standard ambient conditions would exist in a vapor state.

BRIEF DESCRIPTION OF THE DRAWINGS

While the specification concludes with claims distinctly pointing out the subject matter that Applicant regards as his invention, it is believed the invention will be better understood when taken in connection with the accompanying sole figure which is a schematic of a cryogenic delivery apparatus in accordance with the present invention.

DETAILED DESCRIPTION OF THE DRAWINGS

With reference to the Figure, a cryogen delivery apparatus 1 in accordance with the present invention is illustrated. Cryogen delivery apparatus 1 includes a vessel 10 to contain cryogen in liquid and vapor phases. The vapor phase is contained within a head space region 12 of vessel 10. Cryogen enters a bottom region 14 of vessel 10 by means of a bottom inlet 16. A vapor outlet 18 is provided for discharging vapor from headspace region 12 of vessel 10. A headspace inlet 20 is also provided for introducing vapor into head space region 12 of vessel 10.

If the cryogen is supplied to vessel 10 in a state of two phase flow, then vessel 10 will act as a phase separator to separate the cryogen into the liquid and vapor phases. In this case, depending on whether the vapor is being supplied to the process, the excess vapor will be periodically vented from the apparatus through vapor outlet 18. In the event that the liquid is subcooled, a means is provided for indirectly exchanging between the vapor located within the head space and a liquid stream composed of the liquid phase, which means is preferably a heat exchanger 22 located within head space region 12. Heat exchanger 22 is formed from finned tubing 24 which is arranged in series passes 26, 28, 30 and 32 which are connected by U-shaped fixtures 34 and 36. Liquid is introduced into heat exchanger 22 by means of a withdrawal tube 38 which would be connected to pass 26 by means of a 90° elbow-like fixture which has been broken away for purposes of illustration. As can be appreciated, heat exchanger 22 could be constructed in any number of ways, including a simple coil of bare tubing. Heat exchanger 22 condenses vapor within head space region 12 and thus converts subcooled liquid into saturated liquid. The saturated liquid is discharged from vessel 10 through liquid outlet 40.

Vessel 10 is provided with a depending volume 42 through which withdrawal tube 38 extends and has bottom inlet 16 defined therein. Depending volume 42 allows withdrawal tube 38 to extend below bottom inlet 16 in order to prevent vapor being drawn into heat exchanger 22 in case the entering liquid is a two phase flow. The foregoing depending volume 42 is a preferred though optional feature of cryogen delivery apparatus 1.

Liquid level will tend to rise within cryogen delivery apparatus 1 as more subcooled liquid is converted into saturated liquid or as more vapor is discharged from vapor outlet 18. It is to be noted that certain applications additionally require vapor which must be replenished. In order to increase the amount of vapor within head space region 12, a branched supply line 44 is provided having a liquid inlet branch 46 connected to bottom liquid inlet 16 so that liquid supply flows into vessel 10 and the vapor inlet branch 48 connected to head space inlet 20. A heater illustrated as a heating coil 50, powered by an electrical power source 52, heats incoming liquid and converts it to vapor. It is also to be noted that an electrical heater is only one of many possible means for heating vapor inlet branch 48. For instance, process heat from other heating sources could be used for the same purpose. It may be noted that the liquid level in branch 48 will be at the same level as inside the vessel, therefore no active control means is required to supply liquid to heater 50.

Although, as indicated above, power could be continually supplied to heating coil 50, in the illustrated embodiment, the operation of heating coil 50 is automatically controlled in response to the level of liquid within vessel 10. To this end, a level detector 53 is provided to sense an upper level of liquid within vessel 10. Such upper level is designated by reference "A". A lower level of liquid, designated by reference "B" is sensed by level detector 54. Level detectors 53 and 54 are "point level detectors" (of the type illustrated in U.S. Pat. No. 5,167,154) which are designed to generate signals when liquid level has risen to level A or has fallen below level B. It is understood that thermocouples could be used to sense the level of liquid, electro-mechanical devices and etc. Additionally, although not illustrated, level detectors 53 and 54 could be set in wells to prevent their sensing of liquid height from being influenced by liquid sloshing within vessel 10. Alternatively, a continuous level detector, such as a capacitance type probe, could replace both level detectors 53 and 54.

An electrical connection 55 is provided to connect level detector 53 to a controller 56. Similarly an electrical connection 57 is provided to connect level detector 54 to controller 56. Controller 56 is either an analog or programmable logic controller. When the liquid level of the liquid phase rises to level A, controller 56, responsive to level detector 53, supplies electrical current, provided by power source 52, to heating coil 50. This control causes liquid to be vaporized and the vapor to flow into head space region 12. In the event that the liquid level falls below level B, controller 56 acting in response to level detector 54 activates a remotely activated valve 60 connected to vapor discharge outlet 18 to open and discharge vapor. Remotely activated valve 60 is connected to controller 56 by an electrical connection 62. In such manner the liquid level will be constrained to remain within the range of height that is defined between levels A and B. Preferably, heating coil 50 or other heating source is positioned on vapor inlet branch 48 so that it is below liquid level A to prevent it from acting to superheat vapor evolved from the liquid. Even more particularly, heating coil 50 is positioned below liquid level B.

Controller 56 might also be used to trigger the supply of liquid in response to process requirements. To this end, a remotely operated valve 64 is illustrated as being connected to liquid outlet 42. Remotely operated valve 64 is electrically connected via electrical connection 66 to controller 56. Depending on the process requirements additional outlets from the liquid or vapor space could be provided.

While the present invention has been described with reference to a preferred embodiment, as will be understood by those skilled in the art, numerous additions, omissions and changes can be made without departing from the spirit and scope of the present invention.

I claim:

1. A cryogen delivery apparatus for delivering a cryogen in a saturated state, said cryogen delivery apparatus comprising:

a vessel to contain said cryogen in liquid and vapor phases and to phase separate said cryogen into said liquid and vapor phases in case said cryogen is introduced into said vessel as a two phase flow;

said vessel having, a headspace region, a bottom inlet for introducing said cryogen into said vessel, a vapor outlet for discharging vapor from said headspace region, and a headspace inlet for introducing vapor into said headspace region;

heat exchange means for indirectly exchanging heat between said vapor located within said headspace and a liquid stream composed of said liquid phase of said cryogen so that in case said cryogen is introduced into said vessel as a subcooled liquid, said vapor will condense into said liquid phase and said subcooled liquid will be convened into a saturated liquid;

a liquid outlet connected to said heat exchanger for discharging said liquid stream from said vessel;

a branched supply line having a liquid inlet branch connected to said bottom liquid inlet so that a supply stream composed of said cryogen flows into said vessel and a vapor inlet branch connected to said headspace inlet; and heater means for heating said vapor inlet branch of said branched supply line so that liquid cryogen is vaporized within said vapor inlet branch to produce said vapor in case said vapor within said headspace is depleted through condensation or through discharge through said vapor outlet.

2. The cryogen delivery apparatus of claim 1, wherein said heat exchange means comprises a heat exchanger located within said headspace and a withdrawal tube in communication with said heat exchanger and depending therefrom to draw said liquid cryogen from said vessel to said heat exchanger.

3. The cryogen delivery apparatus of claim 1, wherein said heater means comprises an electrical heating coil to heat said vapor inlet branch.

4. The cryogen delivery apparatus of claim 1, wherein said heater means is configured to be activated when said liquid phase has a height above an upper set point level and said cryogen delivery apparatus also comprises level detector means for detecting when said liquid phase rises above said upper set point level and means responsive to said level detector means for activating said heater means when said liquid phase rises above said upper set point level.

5. The cryogen delivery apparatus of claim 4, wherein said actuable heater means comprises an electrical heating coil to heat said vapor inlet branch.

6. The cryogen delivery apparatus of claim 4, wherein:

a remotely activated valve is connected to said vapor outlet;

said level detector means also detects when said liquid phase falls below a lower set point level;

said heater activation means comprises a controller also having means responsive to said level detector means for activating said valve when said liquid phase falls below said lower set point level.

7. The cryogen delivery apparatus of claim 6, wherein said actuable heater means is positioned below said upper set point level.

8. The cryogen delivery apparatus of claim 4, wherein said heat exchange means comprises a heat exchanger located within said headspace and a withdrawal tube in communication with said heat exchanger and depending therefrom to draw said liquid cryogen from said vessel to said heat exchanger.

9. The cryogen delivery apparatus of claim 8, wherein:

a remotely activated valve is connected to said vapor outlet;

said level detector means also detects when said liquid phase falls below a lower set point level;

said heater activation means comprises a controller also having means responsive to said level detector means for activating said valve when said liquid phase falls below said lower set point level.

10. The cryogen delivery apparatus of claim 9, wherein said heater means is positioned beneath said upper set point level.

11. The cryogen delivery apparatus of claim 10, wherein said heater means comprises an electrical heating coil to heat said vapor inlet branch.

* * * * *